United States Patent [19]

Josenhans

[11] 4,053,153

[45] Oct. 11, 1977

[54] BILLIARD-BRIDGE AND STROKE TRAINER

[76] Inventor: Frederick G. Josenhans, 14020 Netherfield Drive, Midlothian, Va. 23113

[21] Appl. No.: 681,553

[22] Filed: Apr. 29, 1976

[51] Int. Cl.[2] ..... A63D 15/10

[52] U.S. Cl. ..... 273/23

[58] Field of Search ..... 273/23, 24

[56] References Cited

U.S. PATENT DOCUMENTS 3,563,543 2/1971 Hamilton et al. ..... 273/23

FOREIGN PATENT DOCUMENTS 397,937 9/1933 United Kingdom ..... 273/23

*Primary Examiner*—Anton O. Oechsle

*Attorney, Agent, or Firm*—Norman B. Rainer

[57] ABSTRACT

A training device to assist a billiard player to separately or in combination both form a bridge and evaluate the straightness of his cue stick stroke. The device includes a rigid base, a support post extending upwardly from the base, and an elongated cue guide attached to the upper end of the post. The guide is in the form of an open trough having a V-shaped forward end and a semi-circular back end. The support post is capable of limited bending only in a plane which is both perpendicular to the plane of the base and coextensive with the longitudinal axis of the guide. Finger locators are disposed on the upper surface of the base.

3 Claims, 4 Drawing Figures

BILLIARD-BRIDGE AND STROKE TRAINER

BACKGROUND OF THE INVENTION

This invention pertains to a training aid device for use in increasing a player's ability in the game of billiards, which name in all of the following includes the game of pocket billiards. The object of these games is to strike one ball, called the cue ball, with the end of a shaft called a cue stick in such a manner and direction that said cue ball will roll to another ball herein called the object ball, and hit the object ball in such a location and a manner that said object ball will travel a specific predetermined path, as to a pocket for scoring. For a player to have a cue ball strike accurately at a target point he must develop a repeatable ability to strike the cue ball in such a manner that said cue ball will travel to the aiming point, or contact point with an object ball. "English", which is any rotation given to the cue ball by the manner in which it is struck by the cue stick, which rotation is other than normal rolling, may have an effect upon the path of the cue ball and/or the direction of the object ball after contacted by the cue ball, and is to be avoided by one learning the game. "English" will, when imparted accidentally to the cue ball by an incorrect stroke, cause the player to reduce his ability to have the object ball travel as desired, although it may be used to advantage by advanced players.

"English" is avoided, and normal rolling is achieved by having the cue tip strike the cue ball while said cue tip and the entire cue stick is being directed along a line passing along the axis of said cue and through the center of said cue ball, all while said axis is essentially parallel to the playing surface.

Several errors in "stroking" the cue ball, which stroking is the bringing of the cue tip into contact with said ball contribute to "English". One of these is an unsteady "bridge"; the "bridge" being the hand supporting and guiding the cue stick above the table surface, normally with the index finger being wrapped around said cue stick. An unsteady bridge does not accurately control the path of the cue tip to its desired point of contact with the cue ball even if the cue is otherwise correctly stroked.

A second error contributing to english is for the "stroking" hand holding the other end of the cue to move along a path other than the axis of the cue extending through the center of the cue ball.

Various devices have heretofore been proposed as bridge aids for use in games such as billiards. Furey U.S. Ser. No. 953,167 and Ciano U.S. Pat. No. 3,416,794 purpose supporting a cue guide on the player's finger, or holding same in the player's hand. The present invention has the advantage of assisting a player in learning to form a good bridge hand. The present invention has a second advantage in providing an artificial fixed bridge which enables the player to either visually or physically or both evaluate the straightness of his stroke independent of whether he is able to establish a steady bridge with his hand. The present invention has a third advantage in providing a fixed bridge which will maintain a degree of restraint against side-wise movement at the bridge of a tapered cue throughout its stroke. Table supported devices as Ruhland U.S. Ser. No. 690,617, Williamson U.S. Ser. No. 855,684 and Furda U.S. Pat. No. 2,931,649 have been developed as bridge assists in playing the game. In contrast, the present invention is not intended for such use, but for training.

Accordingly, a basic object of the present invention is to assist the player in forming a correct bridge for support of the tip end of the cue stick.

A second basic object of the present invention is to provide an apparatus to assist the player in observing visually as well as physically that the path of the cue stick is essentially along the prescribed axis, without lateral pivoting during its travel, such pivoting normally being around a point which is the center of the bridge in the horizontal plane.

A third basic object of the apparatus of the present invention is to accomplish both of the above objects without complete restriction, allowing the user to observe and improve his own control rather than be restricted to complete control by the apparatus.

A further object of the invention is to provide an inexpensive device for the aid of development of both an effective bridge and of the basic stroke of the cue stick in the game of billiards.

BRIEF DESCRIPTION OF THE DRAWINGS

These and other objects of the invention arising from the details thereof will be apparent from the following description and accompanying drawings, wherein.

Similar characters of reference indicate similar or identical elements and portions throughout the views of the drawings.

DETAILED DESCRIPTION OF THE INVENTION

Figure 1:
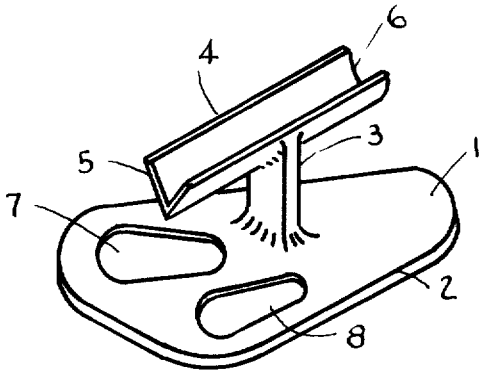
FIG. 1 is a perspective view of a billiard training aid device of one piece construction made from reasonably or completely stiff plastic or other material.

Referring now to FIG. 1 of the drawings, the device 1 is an integral unitary member of reasonably or completely stiff material or a composite member of several materials having a base 2 being flat on the bottom for support of the device on the flat playing surface, having one or more finger locating markings 7, 8 and being of a convenient size and shape. The post 3 has a length convenient to the forming of a "bridge" by the player or a group of players having some variety of hand sizes. The post 3 is either rigid or preferably flexible to a small degree of bending in a plane perpendicular to the plane of the flat surface of the base 2, but the flexibility to bend in any other plane is purposely limited by the design of said post. The post 3 may also have flexibility for a small degree of twisting about its center line. The cue support 4 is a member supported and contiguous to the post 3 and designed to receive and support the cue stick at the tip end of the support, the balance of the support being designed for visual comparison of the cue stick axis relative to the axis of the support at any time before, during and after a stroke of the cue stick. The tip end 5 of the cue support 4 is of a configuration allowing for continued and accurate support of the striking tip end of the tapered cue stick during its stroke. Said configuration may be a portion of a circle but is preferably a "V", although other configurations may serve the purpose. The remainder and back end 6 of the cue guide may be a "V" or other compatible shape but is preferably of a half circle configuration having an inside diameter slightly greater than the largest diameter of the tapered cue stick that will come to the back end 6 of the cue support during the stroke of said cue stick, providing the user or an observer with the ability to view from above at least one point or set of points on one or both sides of the cue guide reasonable distance behind the tip end throughout the stroke and to provide the user with the ability to physically notice any contact of the cue with a side of the cue guide during the stroke, both separately providing an ability to judge the trueness of the stroke. The inside diameter of the half circle configuration may range from about ⅜ to 1 inch. The tip end 5 of the cue support 4 together with the back end 6 of said support are arranged in such a manner in relation to cue support 4 that other portions of cue support 4 do not interfere with the functions of said tip end 5 and back end 6. Cue support 4 is desirably but not necessarily roughly parallel to the plane of the flat surface of the base 2, when post 3 is in its normal unflexed position. The middle finger locator 7 is marked on or indented or raised on base 2 as is finger locator 8 which may be used for the fourth or fifth fingers. The locations of locator 7 and locator 8 are on opposite sides of a vertical plane through the long axis of cue guide 4 to provide a guide to the player in fixing his hand in a preferred and stable "bridge" position. Other finger locators may be added if desired.

Figure 2:
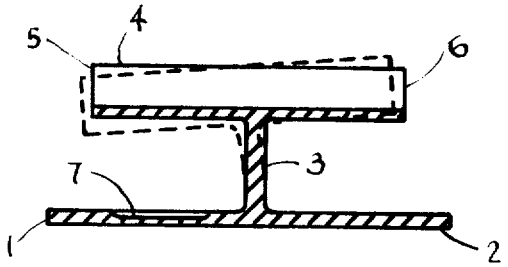
FIG. 2 is a sectional side view of the device of FIG. 1.

FIG. 2 shows a section through a side view of a billiard training aid device 1 showing the base 2 contiguous with the post 3 which is in turn contiguous to the cue stick support 4 having a tip 5 and back end 6. Post 3 in the design has a thickness in side view less than its thickness in a front view as indicated in FIG. 1 to provide a flexibility for bending in the plane of the side view as shown by dashed lines but restricted bending in other planes. The post and guide may be of monolithic structure, with said base having a socket to receive and hold the structure.

Figure 3:
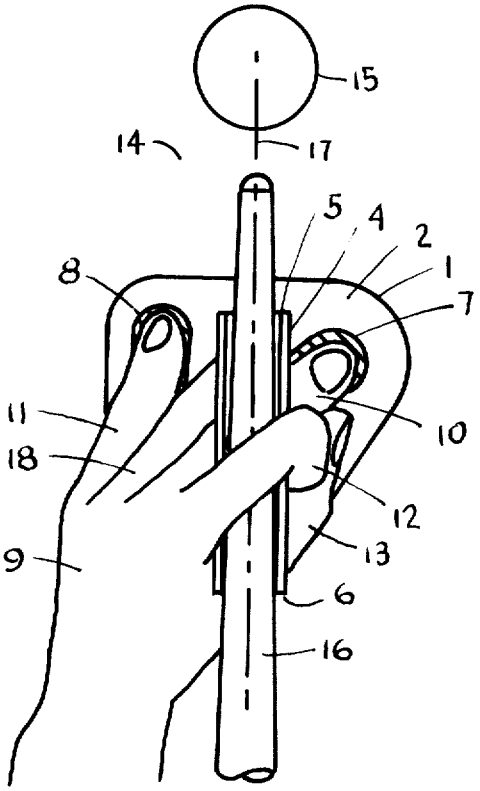
FIG. 3 is a plan view of a billiard training aid device in accord with the invention illustrating the relationships of the device with a cue ball, and with the player's hand and the cue stick, all on the playing surface of a billiard table prior to a play.

FIG. 3 shows a plan view of the playing surface 14 on which is located cue ball 15 and billiard training aid device 1 oriented such that the axis 17 of the cue 16 intersects a vertical line passing through the center of said cue ball 15 and preferably through the center of said cue ball 15, when said cue 16 is resting on the tip end 5 and back end 6. Also shown is the player's hand 9 positioned in such a manner that the thumb 13 is below the cue support 4 and on the back end 6 side of the post 3 (not shown). The index finger 12 is over and partially around both the cue 16 and the cue guide 4. The middle finger 10 is below cue guide 4 and resting on the middle finger locator 7. The small finger is located on the finger locator 8. The remaining finger 18 is located as comfortable to the player. The "bridge" shown is the conventional one, and other "bridges" may be used with the device 1.

Figure 4:
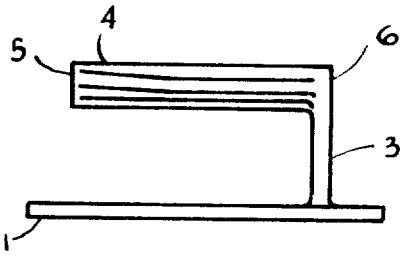
FIG. 4 is a side view of an alternative embodiment of a billiard training aid device of the present invention.

FIG. 4 shows an alternate position of post 3 at the back end 6 of cue support 4. Post 3 may be located at the tip end 5 instead if desired. When the post 3 is located at the back end 6 or the tip end 5 of the cue support 4 the "bridge" may be formed in any desired manner whether post 3 is between or outside a plurality of fingers.

In the case of left-handed players, who would bridge with their right-hand, the apparatus would be designed essentially as a mirror image of that shown in FIGS. 1 and 3, although the essential differences in design reside only in the finger locators 7 and 8. The apparatus can therefore be designed to have adjustable or both finger positions to accommodate both left or right hands.

I claim:

1. A bridge and stroke training device comprising a rigid base, a support post of convenient height extending upwardly from said base, an elongated cue guide of convenient length attached to the upper end of said support post and positioned in a plane essentially horizontal to said base, said guide being an open trough having a V-shaped forward end and a back end having a semi-circular configuration, said support post being capable of limited bending movement only in a plane perpendicular to the plane of said base and coextensive with the longitudinal axis of said guide.

2. The device of claim 1 wherein said base has one or more finger locating positions.

3. The device of claim 1 in which said post and guide are of monolithic structure, with said base having a socket to receive and hold the structure.

* * * * *